United States Patent [19]

Moritz

[11] Patent Number: 4,805,732

[45] Date of Patent: Feb. 21, 1989

[54] MOTOR POWERED SOUND EMITTER

[75] Inventor: Mats Moritz, Trelleborg, Sweden

[73] Assignee: Prodeo AB, Malmo, Sweden

[21] Appl. No.: 113,664

[22] Filed: Oct. 28, 1987

[30] Foreign Application Priority Data

Oct. 31, 1986 [SE] Sweden ..... 8604685

[51] Int. Cl.[4] ..... G10K 11/00

[52] U.S. Cl. ..... 181/175; 181/159; 181/161; 181/177; 381/152; 381/156

[58] Field of Search ..... 181/152, 143, 157, 159, 181/161, 175, 177, 181; 381/152, 156, 161, 188, 191; 340/384 R, 387-390, 405

[56] References Cited

FOREIGN PATENT DOCUMENTS 644066 4/1937 Fed. Rep. of Germany .
2461851 6/1976 Fed. Rep. of Germany .
2550078 8/1976 Fed. Rep. of Germany .
595411 3/1978 U.S.S.R. .
915043 1/1963 United Kingdom .
1312747 4/1973 United Kingdom .

*Primary Examiner*—B. R. Fuller
*Attorney, Agent, or Firm*—Laurence R. Brown; Alfred J. Mangels

[57] ABSTRACT

In a sound emitter including an emitting piston powered by a three phase asynchronous electric motor, the torque curve of the motor may be adjusted to suit any temperature, causing variations in the emitted resonance frequency by using a motor having its maximum torque at less than half the maximum speed. This may be done by using an alloy of silicon and aluminum in the rotor winding.

10 Claims, 1 Drawing Sheet

MOTOR POWERED SOUND EMITTER

FIELD OF THE INVENTION

This invention relates to a motor powered sound emitter.

More particularly the invention relates to a sound emitter of the type in which a sound wave is generated by a piston arranged to oscillate in a housing connected to a horn in which—at the working speed of the motor and at normal temperature—resonance waves occur in the horn, said piston being powered by a three phase asynchronous electric motor via a suitable gear train.

THE PRIOR ART

Motor powered sound emitters may be preferred instead of air powered emitters on large ships. This may be due to lack of sufficient capacity of compressed air or it may be due to a desire of a more simple installation. Finally a motor powered sound emitter may be used as a second source to existing compressed air powered emitters.

It will be understood that due to variations in speed of the sound in air and thus variations of resonance frequency of a horn with fixed geometrical dimensions, the frequency of the oscillating piston must be varied.

Three phase voltage is normal standard on ships as well as on shore. Three phase asynchronous motors are cheap and reliable. Therefore—e.g. in UK Patent Specification 1312747—it has previously been proposed to provide the three phase asynchronous motor with a special governing system allowing a stepwise adjustment of the motor speed in dependance of the ambient temperature in order to obtain an efficient sound emitting in any climate between the tropical and the arctic. The adjustment is performed by automatic, stepwise application of supplementary voltage and/or resistance in one or more of the motor phase windings.

However, such a governing system is rather complicated and very expensive.

A three phase asynchronous motor has normally its greatest torque at a speed which is 80–90% of the maximum speed (at zero torque).

However, special engines may have their maximum torque at start. This is obtained by using a large, constant resistance in the rotor winding of the motor. Engines of this type are known from UK Patent No. 915,043; German Patents Nos. 2461851, 2550078 and 644066 and they are used in servo systems.

One way of making the rotor windings of the motor resistive is to make it from an impure metal. E.g. an alloy of silicon and aluminum could be used to substitute pure aluminum—see SU 595411, Derwent's Abstract No. 5757 B/03.

Such resistive motors have a poor efficiency and are thus not generally used.

OBJECT OF THE INVENTION

The object of the present invention is to provide a sound emitter which may function satisfactorily in any climate and which is cheap to manufacture and reliable in operation.

SUMMARY OF THE INVENTION

According to the present invention the sound emitter is characterised in that the three phase asynchronous motor selected is a type having its maximum torque at a speed less than ½ of the maximum speed of the motor.

BRIEF DESCRIPTION OF THE DRAWING

The invention will be described below in more detail reference being made to the accompanying drawing in which.

DETAILED DESCRIPTION OF THE INVENTION

Figure 1:
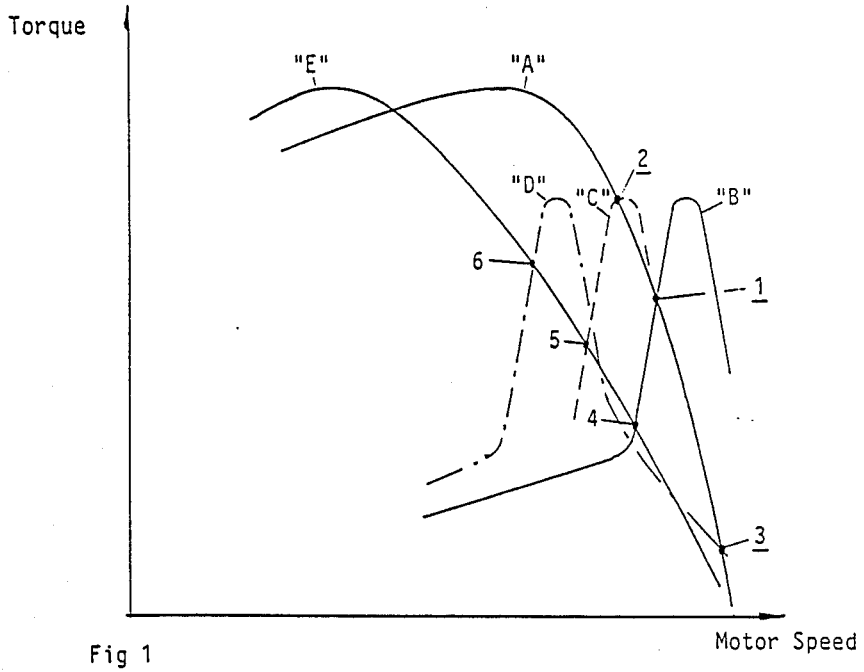
FIG. 1 shows diagrams of motor torques and acoustic loads in emitters according to the prior art as well as according to the present invention.

In FIG. 1 the curve "A" shows the torque of a conventional three phase asynchronous motor versus the motor speed. As is well known the maximum speed at zero torque is obtained near the speed set by the frequency of the current. It is also observed that the torque rapidly increases with decreasing motor speed. The maximum torque is obtained at about 20% lower speed than the maximum speed.

The curve "B" shows the load torque transmitted by the drive mechanism of a sound emitter of the type in which the sound waves are generated by an oscillating piston. The curve "B" is translated to the torque on the motor axis. In reality the piston oscillates with about 3 times higher frequency.

As shown in FIG. 1 the torque load on the piston rod suddenly increases substantially. This is due to resonance waves in the horn of the sound emitter resulting not only in an increased power consumption, but also in emitting a very loud sound having a specific frequency.

Curve "B" shows the resonance occurring at normal temperature. If the temperature drops the resonance will occur earlier—i.e. at lower speeds. Curve "C" is the resonance curve at a temperature 20 degrees centigrade lower than that of curve "B", and curve "D" at 20 degrees centigrade colder than the temperature of curve "C".

The curves "A" and "B" intersect each other at the point 1 which is located about half way up the resonance peak. This is acceptable, but in case the temperature drops 20 degrees the curves "A" and "C" will intersect at point 2 which is the critical point. A further drop in temperature will result in an intersection between the curves "A" and "D" at a point 3 in which the sound emitter will have lost most of its power in spite of the fat that the motor is running at a higher speed.

Generally an asynchronous motor has a rapidly increasing torque with decreasing speed. Such characteristic is obtained by using a pure metal—e.g. aluminum—for casting the short-circuited windings of the rotor in the motor. For special purposes—e.g. servo-motors—it is known that an asynchronous motor could be modified so as to obtain its maximum torque at start. However, such motors have a low degree of efficiency and are not used commonly as a direct power source.

In FIG. 1 the curve "E" depicts the torque of a resistive motor—a motor in which the resistance in the rotor windings has been increased by purpose—e.g. by using a silicon aluminum alloy in stead of pure aluminum. The curve "E" intersects the curves "B", "C" and "D" at the points 4, 5 and 6 respectively. It will be understood that all three points 4, 5 and 6 are located on the front side of the peak parts of the curves "B", "C" and "D". Also, it will be observed that the vertical distance between the points 4 and 5 is substantially smaller than the vertical distance between the points 1 and 2.

Figure 2:
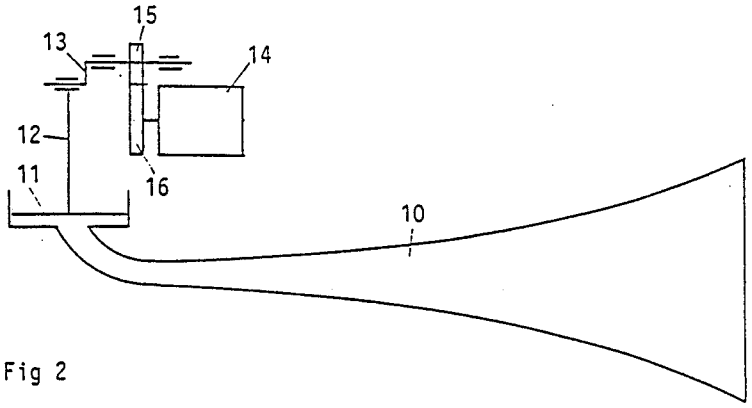
FIG. 2 shows schematically a sound emitter according to the invention.

Therefore, the inventive use of a special motor in a sound emitter of the type referred to will result in a sound the frequency of which will vary with the temperature, but it will have a well defined frequency at any temperature, and the power of the emitted sound will be large at any temperature. FIG. 2 shows the basic design of a sound emitter according to the invention.

A horn 10 is at its narrow end closed by a piston 11 activated by a connection rod 12 journalled in a crank shaft 13. Said crank shaft is powered by an asynchronous electric three-phase motor 14 via a gear train 15, 16 increasing the speed of the crank shaft 13 to three times that of the motor 14.

During running of the motor 14 the piston 11 wil perform vibrations at a predetermined frequency between 75 and 200 Hz. The length of the horn 10 is such that a sound wave of said predetermined frequency will be reflected and reach the piston during intervals when the piston 11 is moving downwards. The said frequency corresponds to the base of the peak on curve "B" of FIG. 1 at about 20 degrees centigrade at point 4.

The difference between the characteristic torque curve "A" according to the prior art and the torque curve "E" of the motor used according to the invention is solely due to the design of the rotor of the motor. As is well known in the art the rotor of an AC asynchronous motor has a short circuited winding around a core consisting of iron sheets. The winding is normally made by casting a pure metal such as aluminum or magnesium. It is also known that impurities in the metal winding will make the motor more resistive, i.e., a slower torque rise will occur at decreasing motor speed. The rotor winding could preferably consist of an alloy of silicon and aluminum.

I claim:

1. A sound emitter for generating a sound wave by a motor driven piston arranged to oscillate in a housing connected to a horn in which—at a working speed of the motor and at normal temperature—resonance sound waves occur in the horn, said piston being oscillated by a three phase asynchronous electric motor connected to the piston by a gear train, wherein the three phase asynchronous motor has a maximum torque at a speed less than ½ of a maximum speed of the motor at zero torque.

2. A sound emitter according to claim 1, wherein the motor includes a rotor winding made of an alloy of silicon and aluminum.

3. A sound emitter comprising:

(a) horn means for conveying sound waves including an inlet and including a sound outlet;

(b) sound producing means for producing sound waves and coupled to the horn means inlet, the sound producing means including housing means communicating with the interior of the horn means and including piston means movable within the housing means to oscillate and to generate sound waves in the horn means; and (c) drive means for oscillating the piston means, the drive means including a three phase asynchronous motor having a maximum output torque at a motor speed less than about one-half a maximum motor speed at zero torque.

4. A sound emitter according to claim 3, wherein the sound producing means includes oscillation means connected with the piston means for oscillating the piston at the frequency of about three times the motor speed.

5. A sound emitter according to claim 4, wherein the frequency of oscillation of the piston means is from about 75 Hz. to about 200 Hz.

6. A sound emitter according to claim 4, wherein the drive means includes crank means connected between the piston means and the motor.

7. A sound emitter according to claim 6, wherein the drive means includes gear train means connected between the crank means and the motor.

8. A sound emitter according to claim 3, wherein the motor includes a metallic alloy rotor winding that has a higher resistance than a corresponding rotor winding made from the pure metal forming the major constituent in the alloy.

9. A sound emitter according to claim 8, wherein the rotor winding is made from an alloy of silicon and aluminum.

10. A sound emitter according to claim 3, wherein the motor has a fixed torque-speed characteristic curve that is independent of the ambient temperature.

* * * * *